US005560335A

United States Patent [19]

Bellon et al.

[11] Patent Number: 5,560,335

[45] Date of Patent: Oct. 1, 1996

[54] DEVICE FOR CONTROLLING THE POWER OF AN INTERNAL COMBUSTION ENGINE

[75] Inventors: Torsten Bellon, Kelkheim; Harald Frey, Sulzbach; Andreas Radlinski, Oberursel, all of Germany

[73] Assignee: VDO Adolf Schindling AG, Frankfurt, Germany

[21] Appl. No.: 303,607

[22] Filed: Sep. 9, 1994

[30] Foreign Application Priority Data

Oct. 2, 1993 [DE] Germany ..... 43 33 701.5

[51] Int. Cl.[6] ..... F02D 7/00

[52] U.S. Cl. ..... 123/399

[58] Field of Search ..... 123/399, 400, 123/361; 74/502.6

[56] References Cited

U.S. PATENT DOCUMENTS

| | | | |
|---|---|---|---|
| 5,076,231 | 12/1991 | Buchl | 123/399 |
| 5,161,504 | 11/1992 | Guest, Jr. et al. | 123/361 |
| 5,161,507 | 11/1992 | Terazawa et al. | 123/399 |
| 5,165,298 | 11/1992 | Shier et al. | 74/502.6 |
| 5,178,112 | 1/1993 | Terazawa et al. | 123/399 |
| 5,193,503 | 3/1993 | Bornmann et al. | 123/339 |
| 5,215,057 | 6/1993 | Sato et al. | 123/400 |
| 5,297,522 | 3/1994 | Buchl | 123/399 |
| 5,423,299 | 6/1995 | Kumagnai | 123/399 |

FOREIGN PATENT DOCUMENTS

| | | |
|---|---|---|
| 2234497 | 1/1975 | France . |
| 2950866 | 6/1981 | Germany . |
| 3403760 | 8/1985 | Germany . |

*Primary Examiner*—Raymond A. Nelli
*Attorney, Agent, or Firm*—Martin A. Farber

[57] ABSTRACT

In order to control the air throughput through the intake pipe of an internal combustion engine, the power of which is controlled by displacement of a throttle valve, there is provided in the intake pipe in known manner a dome-shaped contour which follows the throttle valve over a part of the adjustment angle. Also, the cable pulley has a circular shape in a useful region of operation, but the pulley is fastened eccentrically on the throttle valve. In this way, there is obtained a sensitive displacement by electric motor of the throttle valve in the idling range on the one hand, and a very direct response of the throttle valve to a movement of the gas pedal on the other hand.

2 Claims, 5 Drawing Sheets

DEVICE FOR CONTROLLING THE POWER OF AN INTERNAL COMBUSTION ENGINE

FIELD AND BACKGROUND OF THE INVENTION

The present invention relates to a device for controlling the power of an internal combustion engine by means of a throttle valve which is rotatably mounted in an intake pipe of the engine, wherein a displacement of the throttle valve is effected by an electromotive actuator in the idle range and by a gas pedal via a cable and a pulley in the driving range.

In such devices it is generally desired to obtain the the most linear possible increase of the air throughput, $\dot{m}$, as a function of the adjusted angle, $\alpha$, of the throttle valve in the lower, air flow part of the control range.

For this purpose, it has been proposed to divide the throttle valve in two parts and to turn the two parts independently of each other (German A 29 50 866). Such construction is very expensive and trouble-prone and it has not been able to gain acceptance.

In accordance with another proposal (German C-34 03 760), a pulley which is developed as a cam plate provides that, for the same distance as displacement of the gas pedal, the change in the angle of the throttle valve is considerably less in a lower part of the control range than in an upper part of the control range.

Finally, it has also been proposed to adapt the inner contour of the intake pipe to the path of swing of the throttle valve such that there is less change in the cross section of flow in the lower control range than with a purely cylindrical inner contour of the suction connection (France A-22 34 497). With this method, which is somewhat more expensive from a manufacturing standpoint, it is possible to obtain curves $\dot{m}=f(\alpha)$ which are as flat as desired. As a result, there is a reduction in the maximum mass of air which can be passed through because the change in the inner contour cannot be obtained without a reduction in the cross section of flow. Furthermore, the curve $\dot{m}=f(\alpha)$ has a bend at the place where the throttle valve comes out of the adapted inner contour. The reduction in the maximum air throughput can be compensated for by an increase in the total cross section and the bend can be mitigated by additional measures.

However, it has been found intolerable that the flat characteristic curve $\dot{m}=f(\alpha)$ which is achieved with reference to a sensitive idle regulation by the electromotive actuator drive is accompanied by unsatisfactory acceleration behavior when the control of the power is taken over by the driver. In other words, in the lower control range, too large a pedal path is required in order to obtain the given effect. Basically, there is a conflict between the most economical manner of driving and a forceful style of driving which fully utilizes the power of the internal combustion engine. This conflict could be resolved in favor of economy and the control device could be developed technically in corresponding manner if the development of full power were not required at times in order rapidly to pass another car. In the same way as in the kick-down control of automatic transmissions, it is necessary, in the case of a control device with a flat course of the characteristic curve, to have a possibility of action in order to be able to again have the entire power of acceleration of the internal combustion engine.

SUMMARY OF THE INVENTION

The object of the invention is thus, on the one hand, so to develop an apparatus of the aforementioned type as to obtain a flat course of the air throughput $\dot{m}$ over the angle $\alpha$ of the throttle valve in the lower control range but, on the other hand, also to have the capability of obtaining a large displacement of the throttle valve with short pedal path in the lower control range, without changing the customary total length of the pedal path.

According to the invention, in known manner, a dome-shaped contour which follows the throttle valve over a part of the adjustment angle is provided in the intake pipe. The cable pulley is circular in the useful range, but is fastened eccentrically on the shaft of the throttle valve by displacement of the geometrical center of the pulley from the shaft.

The combination of the inner contour with an eccentric pulley provides the capability of adapting the displacement of the throttle valve to the existing need. This entails use of an electromotive actuating drive in idle operation independently of the displacement of the throttle valve by the gas pedal. In other words, the flat design of the characteristic curve in the lower control region no longer necessarily means a long pedal path in order to reach a given cross section of opening, and a short pedal path in the lower control region does not prevent a sensitive idle control by the electromotive actuating member.

The distance E between the geometric center of the pulley and its point of rotation is preferably 5% to 60% of the radius R of the pulley.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1B:
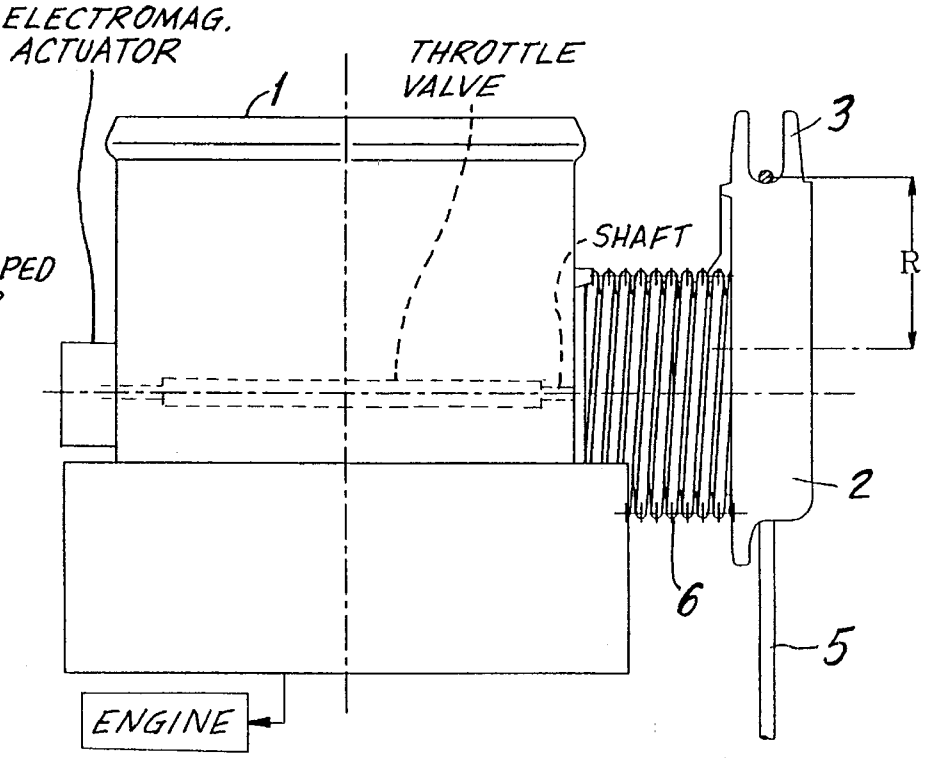
FIGS. 1*a* and 1*b* show front and side views of an intake connection to an internal combustion engine, indicated diagrammatically.
Figure 1A:
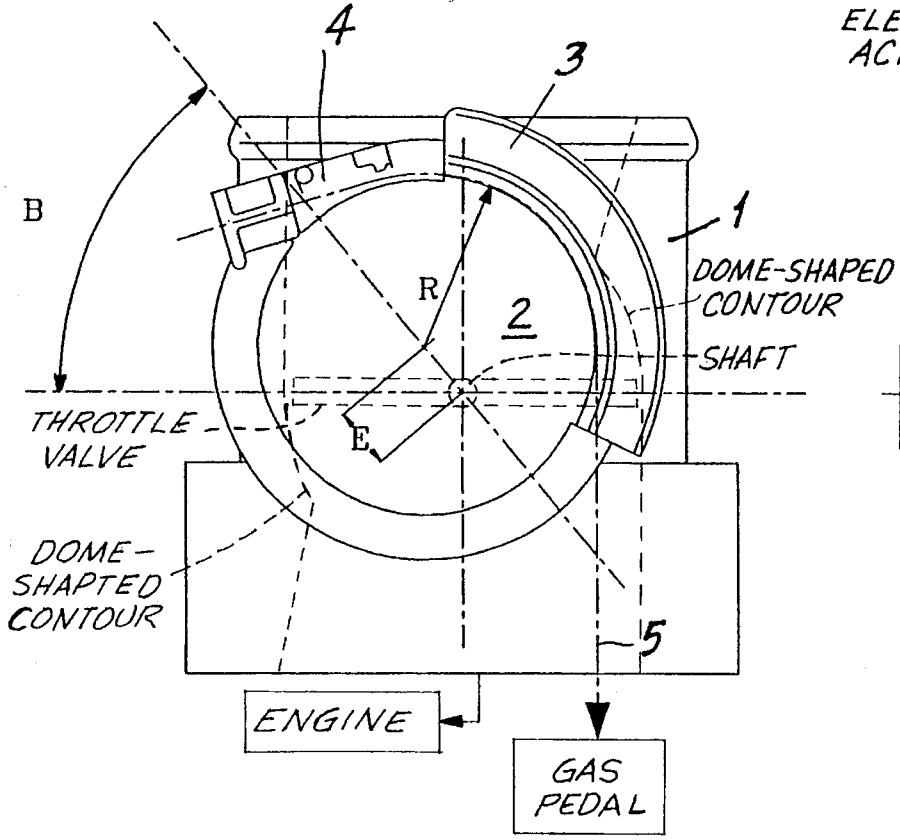

FIG. 1*a* shows in simplified manner an intake pipe 1 in a view looking at a pulley 2. The pulley 2 has a guide 3 and a point of attachment 4 for a cable 5. R is the radius of the pulley, and E the distance between the center of the pulley and the center of rotation of the throttle valve shaft. B is the angle which is formed between the diametral line which passes through the center of the pulley and the center of rotation of the throttle valve shaft, on the one hand, and the center plane of the throttle valve on the other hand.

FIG. 1*b* shows a view, turned 90 degrees, of the intake 1 with the pulley 2, the guide 3, the cable 5, and a return spring 6.

Figure 2:
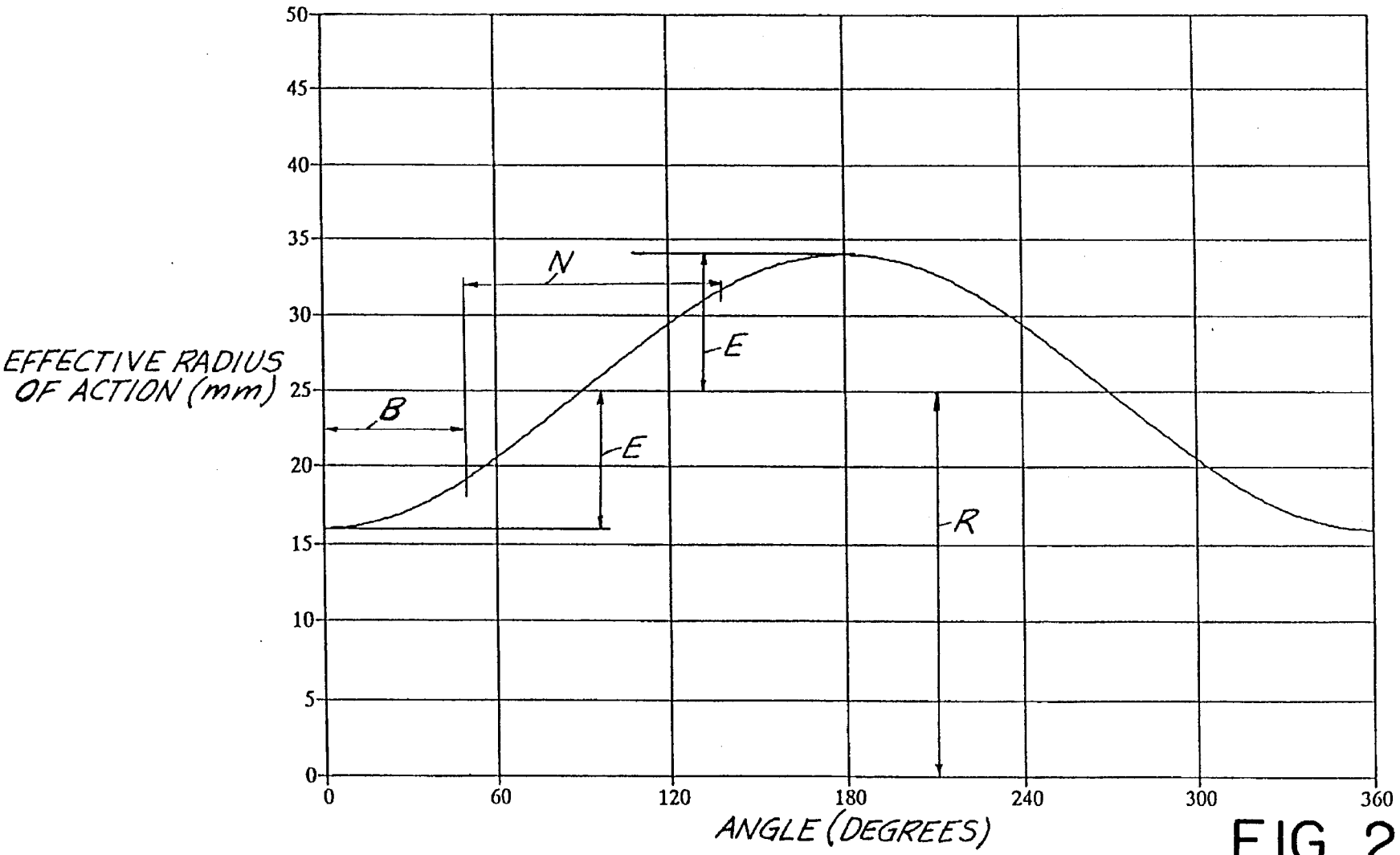
FIG. 2 shows the function $R_{eff}=f(\alpha)$ with an eccentrically fastened pulley.

FIG. 2 shows an example of the effective radius ($R_{eff}$) as a function of the angle of rotation $\alpha$ for a pulley having a radius (R) of 25 mm and an eccentricity (E) of 9 mm. With such a pulley $$R_{eff}=R-E\cdot\cos(\alpha+B),$$

B being the angle which the diametral line through the center point and the center of rotation of the pulley forms with the center plane of the throttle valve. Since the adjustment path of the throttle valve is only about 90 degrees, only a quarter of the region shown is required (useful region N). As a result, it is possible to establish which part of the region it is desired to use, and whether a progressive characteristic curve (0 to 180 degrees) or a digressive characteristic curve (180 to 360 degrees) is to be realized. This freedom is limited if the cable path x is furthermore to assume a specific value. If the region between 0 and 90 degrees is used, there is initially a linearly increasing and then a steeply increasing effective radius with a short length winding and/or a short cable path x. If the region between 90 and 180 degrees is selected, there is initially a strongly increasing effective radius which then becomes more linear with long length of winding and/or long cable path. Beyond 180 degrees, the conditions reverse.

In the embodiment shown in FIGS. 1*a*, 1*b*, a value of 50 degrees has been selected for B. The corresponding useful range for the adjustment of the throttle valve is indicated by N in FIG. 2.

It can be seen that by adapting the parameters R, E and B to each other the characteristic curve can be controlled in various ways and adapted to predetermined conditions. In particular, there is also the possibility of obtaining a given course of the characteristic curve with a predetermined cable path.

Figure 3:
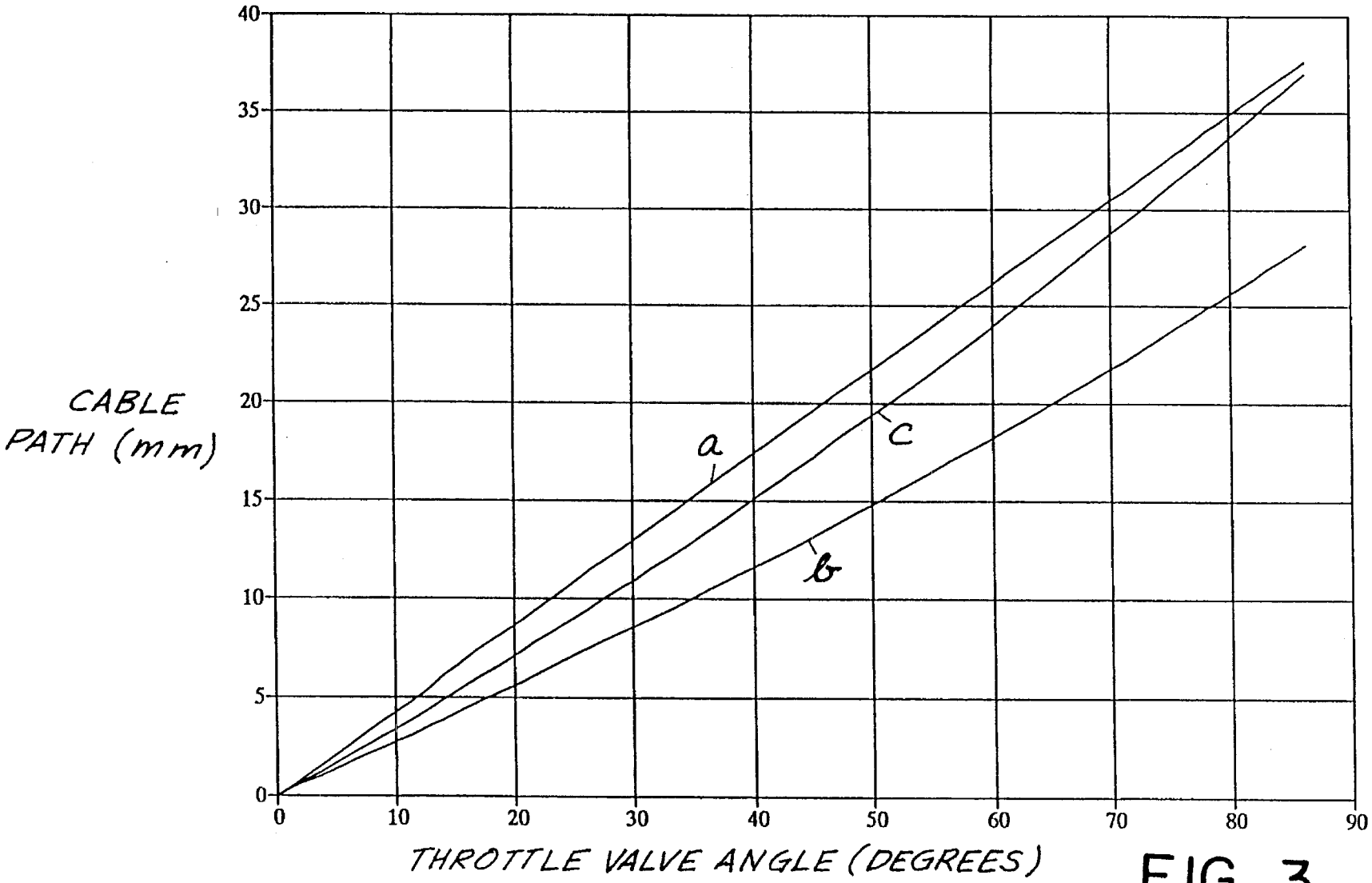
FIG. 3 shows the function $x=f(\alpha)$.

FIG. 3 shows the cable path x as a function of the angle of rotation of the throttle valve. Curve a shows the cable path with a pulley radius R of 25 mm and the values E=0 and B=0. In the case of curve b, E=9 mm and B=0. In the case of curve c, E=9 mm and B=50 degrees. The effect of B on the slope of the curve and on the cable path x can be noted. With given values of the radius R and of the eccentricity E, a given total cable path can only be obtained if $X=f(\alpha)$ becomes steeper or $\alpha=f(x)$ becomes flatter. If it is not desired to dispense with a steep course $\alpha=f(x)$, different values of R, E and B must be selected in order better to be able to approach the conditions "steepness" and "cable length".

Figure 4:
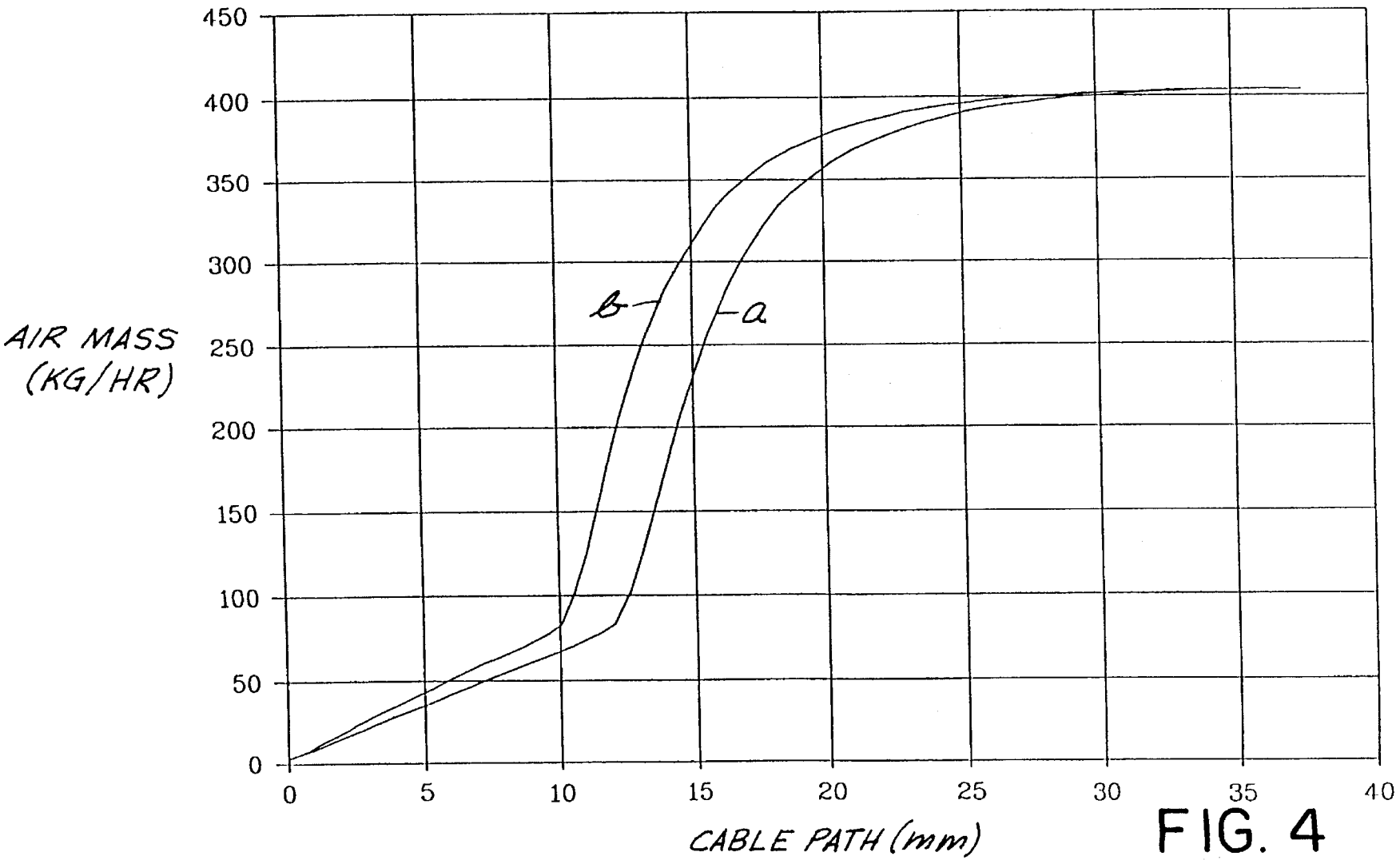
FIG. 4 shows the function $\dot{m}=f(x)$.

FIG. 4 shows how the measures of the invention affect the air throughput. Both characteristic curves show the characteristic course for an intake connection having a dome-shaped inner contour, namely flat initial region, break point, steep middle region and end region which passes asymptotically into the maximum value. Curve a shows the case of a circular pulley of a radius of 25 mm which is fastened in non-eccentric manner onto the throttle-valve shaft. The flat initial region extends up to a cable path of about 12 mm and at a cable path of about 17 mm, an air throughput of 300 kg/hr is reached. The curve b applies to a pulley of R=25 mm, E=9 mm and B=50 degrees. In this case, the break point is reached already at about 10 mm, and a 300 kg/hr value of air throughput is reached at a cable path of about 14.5 mm. The difference becomes even clearer when considering the air throughput reached with a cable path of 12 mm. It jumps from 80 to 200 kg/hr and therefore a factor of two and a half times, and thus satisfies the demands for an idle region which can be finely regulated by electric motor and at the same time provide for good response of the throttle valve to the gas pedal.

Figure 5:
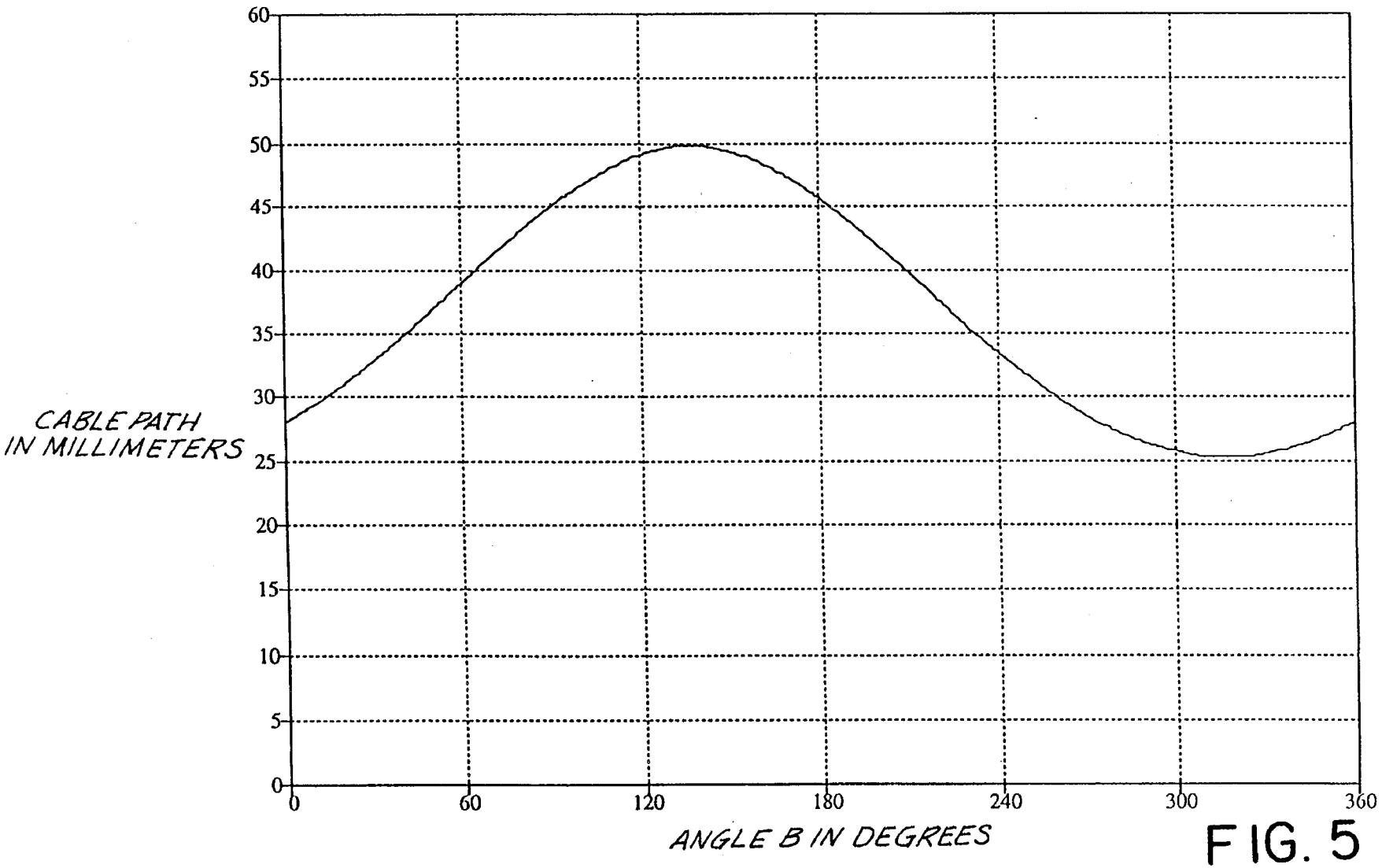
FIG. 5 shows the function $x=f(B)$.

Finally, FIG. 5 again shows directly the influence of the angle B on the cable path x for a pulley of R=25 mm and E=9 mm. If a given total cable path is stipulated, the necessary angle B can be determined immediately for the values R and E on basis of this curve. With corresponding curves for other values of R and E, a complete field of characteristic curves can be established for the application of the inventive concept. It is then readily possible to ascertain the parameters R, E and B for adapting the air throughput to a predetermined curve and/or to relate these parameters to each other.

We claim:

1. A device for controlling the power of an internal combustion engine by means of a throttle valve which is rotatably mounted in an intake connection to the engine, wherein a displacement of the throttle valve is effected by an electromotive actuator in the idle range and by a gas pedal via a cable and a pulley in the driving range, wherein the device comprises a cable pulley connecting with a shaft of the throttle valve, and the cable pulley is circular, but is fastened eccentrically on the shaft of the throttle valve;

a region of the device which encloses the throttle valve is dome shaped; and the eccentricity in the mounting of the cable pulley to the shaft cooperates with the dome-shaped region to provide a linear relationship between air flow through the device and rotational angle of the throttle valve.

2. A device according to claim 1, wherein a distance between the geometric center of the pulley and its point of rotation on the shaft is 5% to 60% of a radius of the pulley.

* * * * *